US007694448B2

(12) United States Patent
Iwasawa

(10) Patent No.: US 7,694,448 B2
(45) Date of Patent: Apr. 13, 2010

(54) RECOIL SHOCK DEVICE IN TOY GUN

(75) Inventor: Tatsuo Iwasawa, Tokyo (JP)

(73) Assignee: Tokyo Marui Co., Ltd., Tokyo (JP)

( * ) Notice: Subject to any disclaimer, the term of this patent is extended or adjusted under 35 U.S.C. 154(b) by 249 days.

(21) Appl. No.: 11/645,578

(22) Filed: Dec. 27, 2006

(65) Prior Publication Data

US 2008/0155875 A1 Jul. 3, 2008

(51) Int. Cl.
*F41A 33/06* (2006.01)
*F41B 7/08* (2006.01)

(52) U.S. Cl. ..... 42/54; 124/54

(58) Field of Classification Search ..... 42/54, 42/55, 57, 58; 124/63, 64, 65, 66, 67, 68, 124/54
See application file for complete search history.

(56) References Cited

U.S. PATENT DOCUMENTS 2,550,887 A * 5/1951 Tratsch ..... 124/54
3,057,102 A * 10/1962 Hirsch et al. ..... 42/57
3,151,411 A * 10/1964 Bonazza ..... 42/55
5,244,431 A * 9/1993 D'Andrade ..... 446/406
5,339,789 A * 8/1994 Heitz ..... 124/56
6,000,386 A * 12/1999 Johnson et al. ..... 124/69
6,003,503 A * 12/1999 Johnson et al. ..... 124/69
2002/0170551 A1* 11/2002 Kotsiopoulos et al. ..... 124/54
2007/0261689 A1* 11/2007 Tai et al. ..... 124/67
2008/0104873 A1* 5/2008 Ducastel ..... 42/54

FOREIGN PATENT DOCUMENTS

JP 6-22793 3/1994
JP 8-89661 4/1996
JP 2000-88494 3/2000

* cited by examiner

*Primary Examiner*—Bret Hayes
(74) *Attorney, Agent, or Firm*—Jacobson Holman PLLC

(57) ABSTRACT

There is provided a recoil shock device capable of obtaining the same recoil shock as that in a case where the weight of a piston is increased, without increasing the weight of the piston by separately providing a movable part and a weight of a piston/cylinder. There is also provided a recoil shock device capable of obtaining a recoil shock similar to that in a real gun, without damaging the outer appearance of a gun. In order to drive a weight to obtain imitated recoil, i.e., a recoil shock by operation of a movable part in a piston/cylinder which generates compressed air, a communicating part 31 which is moved in its retreating direction by the movable part 13 is provided, and a recoil spring 35 which receives a force transmitted to the weight 33 via the communicating part 31 by the movable part 13 so as to be in a compressed state is provided. A reaction that accompanies movement of the weight 33 when the recoil spring 35 is compressed and the recoil spring 35 is then extended by its resilient force is transmitted to a main body 37 of the gun.

4 Claims, 8 Drawing Sheets

RECOIL SHOCK DEVICE IN TOY GUN

BACKGROUND OF THE INVENTION

1. Field of the Invention

The present invention relates to a device capable of obtaining simulated recoil by driving a weight by operation of a movable part in a piston/cylinder unit which generates compressed air.

2. Description of Related Art

Similar to real guns which generate recoil at the time of firing of bullets; attempts to reproduce imitated recoil (recoil shock) in toy guns have conventionally been performed. As recoil imparting methods that appear in toy guns which are put on the market, there is a method capable of obtaining shock by making a weight heavy to obtain shock in a toy gun having a piston/cylinder which generates compressed air. Therefore, it is necessary to make the weight heavy in obtaining sufficient shock. If the weight is made heavy, a need for strengthening a piston spring arises in order to avoid a reduction in the speed of bullets. Strengthening the piston spring increases the load of cocking a piston pump. Consequently, there is a problem in that a cylinder head, the piston itself, an operating mechanism, etc. may be damaged due to impact at the time of advance of the piston, and thereby the durability of the guns may deteriorate remarkably.

Among patent documents which have been filed, Japanese Patent Laid-Open No. 2000-88494 discloses an arrangement in which an operation of pulling a trigger causes a piston rod to protrude which in turn causes a movable shoulder rest to protrude rearward which imparts a shock to a shooter's shoulder. However, this arrangement has a disadvantage that a mechanism, not provided in a real gun, which makes the shoulder rest movable, should be provided. Also, Japanese Patent Laid-Open No. 8-89661 discloses an arrangement in which a slider cover is driven by a solenoid which interlocks with operation of a trigger, thereby imparting recoil. However, this arrangement is not suitable for a rifle-type gun with no slider mechanism. Moreover, Japanese Utility Model Registration Laid-Open No. 6-22793 discloses an arrangement in which an air chamber is pushed to generate pressure by using an impact generated rearward by a spring and a weight along a gun barrel, and this pressure causes bullets of an air gun to be fired. However, this arrangement, which is a special one that impact precedes, firing, is not a general one.

SUMMARY OF THE INVENTION

The present invention has been made taking the above points into consideration. It is therefore an object of the present invention to provide a recoil shock device capable of obtaining the same recoil shock as that in a case where the weight of a piston is increased, without increasing the weight of the piston by separately providing a movable part and a weight in a piston/cylinder unit. It is another object of the present invention to provide a recoil shock device which allows a shooter to feel a recoil shock as in a real gun, without damaging the outer appearance of a gun.

In order to achieve the above object, according to an aspect of the invention, there is provided a recoil shock device in a toy gun which drives a weight to obtain imitated recoil by operation of a movable part in a piston/cylinder unit which generates compressed air, the device includes a communicating part which is moved in its retreating direction by the movable part, and a recoil spring which receives a force transmitted to the weight via the communicating part by the movable part so as to be in a compressed state, wherein a reaction that accompanies movement of the weight when the recoil spring is compressed and thereafter extended by its resilient force is transmitted to a main body of the gun.

The toy gun of the present invention is directed to a gun of a type that generates compressed air using the piston/cylinder unit. Although it is general that the piston/cylinder unit is of a type that a piston slides within a cylinder, there is of a type that the piston is fixed and the cylinder is movable. Since compressed air is generated in any case of these units, driving a weight using either the piston or the cylinder as a movable part becomes the subject of the present invention.

In a toy gun in which compressed air is generated by the piston/cylinder unit, the compressed air can be used to fire bullets. However, if the piston drives the weight due to operation of the cylinder even in a case where any bullet is not fired, it is needless to say that imitated recoil cannot be obtained. Accordingly, with respect to a recoil shock accompanying firing of bullets, the imitated recoil according to the present invention is not performed on the condition that a bullet is fired. That is, the device of the present invention can be applied not only to a toy gun including a bullet firing mechanism but also to a toy gun with no bullet firing mechanism.

The device of the present invention is provided with a communicating part which is moved in its retreating direction on the basis of operation of the movable part composed of either the piston or the cylinder. Since the communicating part functions to receive a force exerted by the movable part to transmit it to the weight, the weight is combined with a coil spring which is brought into a compressed state upon receiving the force. In brief, although the force is transmitted to the movable part, the communicating part, the weight, and the recoil spring in this order, each of the movable part, the communicating part, and the weight is moved by almost the same length in the same direction. Thus, the condition that the piston/cylinder unit is split into three parts is not absolutely necessary, and therefore the number of parts or manufacture in design can be changed arbitrarily.

It is possible to adopt an arrangement in which such movable part, communicating part, and weight are disposed in this order approximately on a straight line. This arrangement is suitable for a gun, such as a rifle having a gun stock with a sufficient length further behind than an engine unit. Further, a portion of the communicating part is disposed in a position where it is retreated by the movable part, and another portion of the communicating part extending parallel to a moving axis of the movable part communicates with the weight. This arrangement is suitable for a case where the device of the present invention is provided in front of, on the right and left, or above the engine unit. The engine unit also includes a bullet loading section which holds a bullet until the bullet is fired from the piston/cylinder unit, when the device including a bullet firing mechanism.

An elastic body which is compressed by retreat movement of the communicating part can be interposed between the communicating part and the weight and/or between the piston and the communicating part. According to the above description, since a force generated in the piston/cylinder unit is transmitted to the movable part, the communicating part, and the weight, the transmission action can be changed to an indirect action, not a direct action by interposing the elastic body between the communicating part and the weight. Further, a gap, though slight, also occurs in transmission time. Moreover, the elastic body functions to absorb a shock accompanying the transmission of force among the piston, the communicating part and the weight to prevent damage thereto.

In addition, a recoil shock starts in a state where a force exerted by the piston/cylinder is transmitted to the weight to bring the recoil spring into a compressed state and the recoil shock becomes remarkable as the weight advances along with the recoil spring which is extended by its resilient force. Thus, in the present invention, the weight retreats with compression of the recoil spring, and thereafter advance of the weight is made synchronized with the advance of the movable part at the time of the advance thereof, so that a shooter can feel a recoil shock like a real gun, even in slight movement of the weight. When a stronger recoil spring is used, it deviates toward faster side, whereas when a weaker recoil spring is used, it deviates toward slower side.

Since the present invention is configured and operates as described above, the weight is driven by the recoil spring by separately forming the movable part and the weight of the piston/cylinder. Thus, the present invention exhibits remarkable effects that the same recoil shock as that in a case where the weight of the piston is increased can be obtained even without increasing the weight of the piston, and the outer appearance of the toy gun also is not damaged.

BRIEF DESCRIPTION OF THE DRAWINGS

The invention will be described with reference to the accompanying drawings, wherein like numbers reference like elements, and wherein.

DESCRIPTION OF THE PREFERRED EMBODIMENTS

Figure 1:
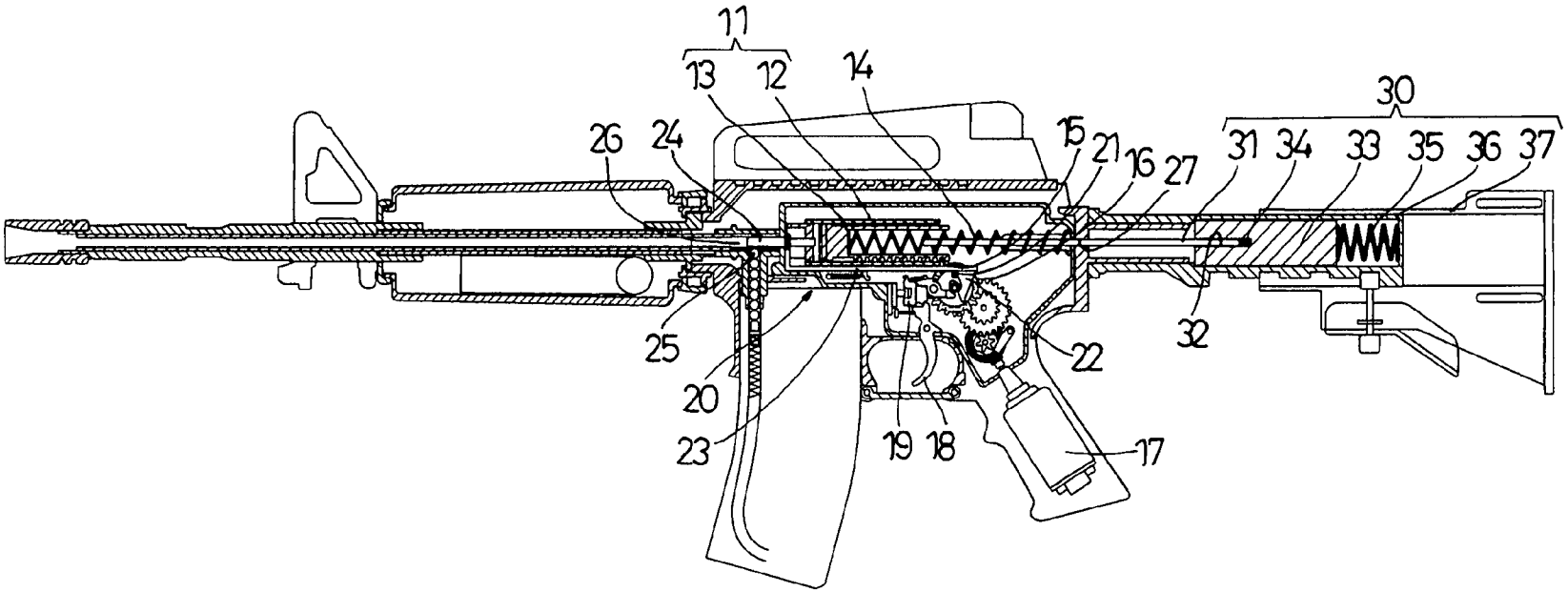
FIG. 1 is a longitudinal sectional view showing Example 1 of a toy gun to which a recoil shock device according to the present invention is applied.

Hereinafter, the present invention will be described in more detail with reference to the illustrated embodiments. FIGS. 1 to 4 show Example 1 of a toy gun 10 to which the present invention is applied. This toy gun has the arrangement of a so-called electric gun having an electric shooting section. An illustrated piston/cylinder unit 11 has a fixed cylinder 12 and a piston 13 which slides within the cylinder. The piston 13 is a movable part. This piston 13 is resiliently energized forwardly by a piston spring 14 which is supported by a rear wall of an engine chamber.

Here, the electric shooting section will be described in brief. The illustrated shooting section has a rack 15 which provided back and forth below the piston. This shooting section performs compression of air by retreat (pressure accumulation of the piston spring 14) and advance (compression of air by release of the pressure accumulation) of the piston by one rotation of a sector gear 16 consisting of a toothed part meshing with the rack and a non-toothed part for quick return. The sector gear 16 is driven by a motor 17 via a set of speed reduction gears. The motor 17 is turned on/off by a switch which can be switched by operation of pulling a trigger 18. A pin 21 is planted on a side of the sector gear 16. A communicating member 23 having an engagement part 22 which retreats by a required dimension by engagement with the pin 21 and the member 23 is extended forwardly of the cylinder to cause a nozzle 24 at a front end of the cylinder 12 to retreat temporarily so that bullets 25 can be supplied into a bullet loading section 26 one by one. The piston/cylinder unit 11, the electric shooting section, and the bullet loading section 26 constitute an engine unit 20.

In the rifle-type toy gun 10 shown in FIGS. 1 to 4, a recoil shock device 30 according to the present invention is disposed approximately in a straight line behind the piston 13 on a moving axis of the piston 13 that is a movable part. Specifically, a rod-shaped communicating part 31 which is moved in a retreating direction by the piston 13 that is a movable part is provided in a thrust bearing 27 provided in the rear wall of the engine chamber so as to be capable of advancing or retreating. A front end of the communicating part 31 is capable of contacting the piston 13, and a rear end of the communicating part 31 is inserted into a guide hole 32 formed in a front part of a weight 33. An elastic body 34, which is interposed between the communicating part 31 and the weight, is composed of a small spring disposed in the guide hole 32, and a coil spring 35 which is compressed as it receives a force transmitted to the weight 33 is disposed in a rear end inside a case 36 which houses the weight 33.

Figure 2:
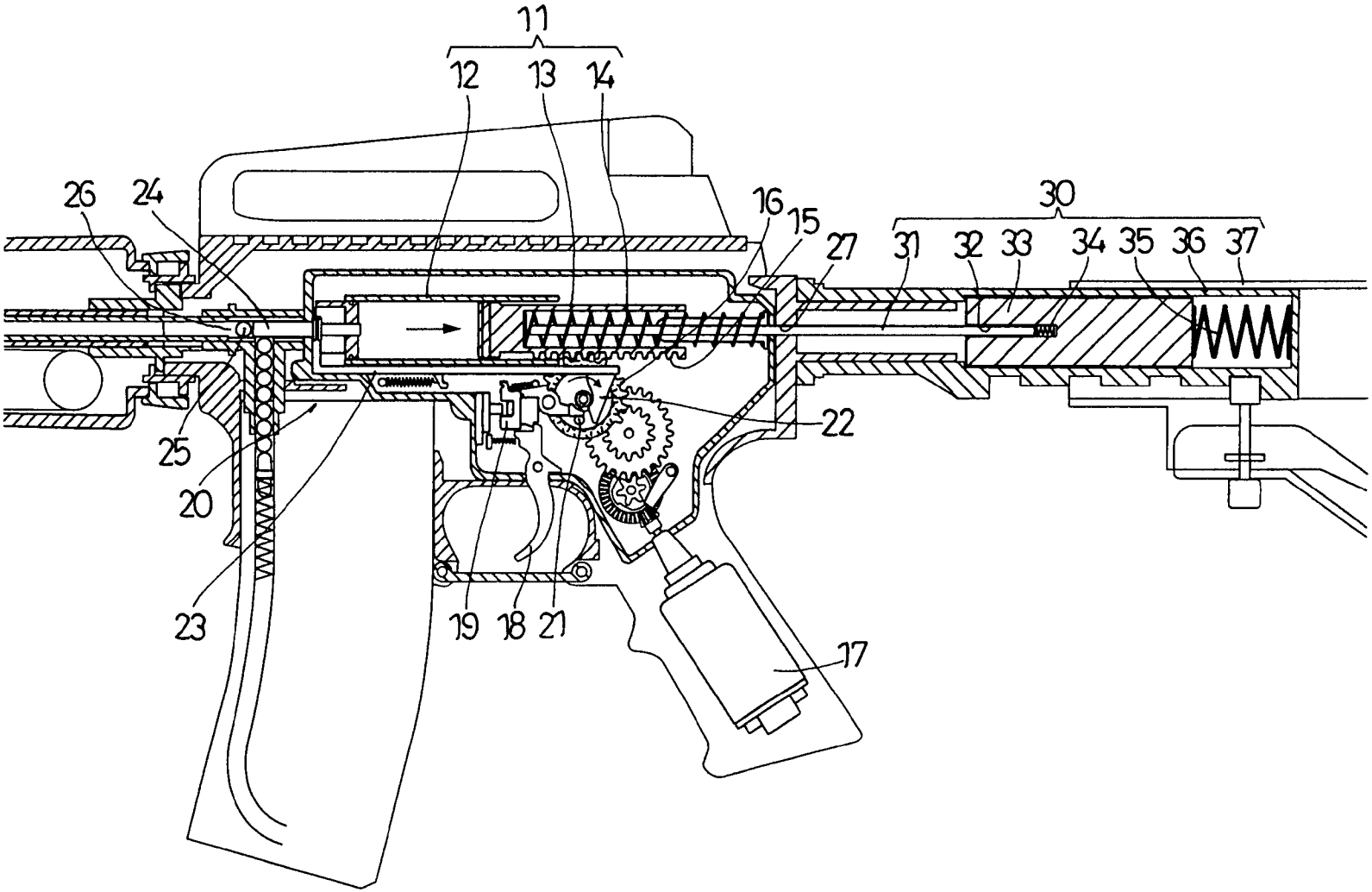
FIG. 2 is a longitudinal sectional view of Example 1 of the device shown in FIG. 1.
Figure 3:
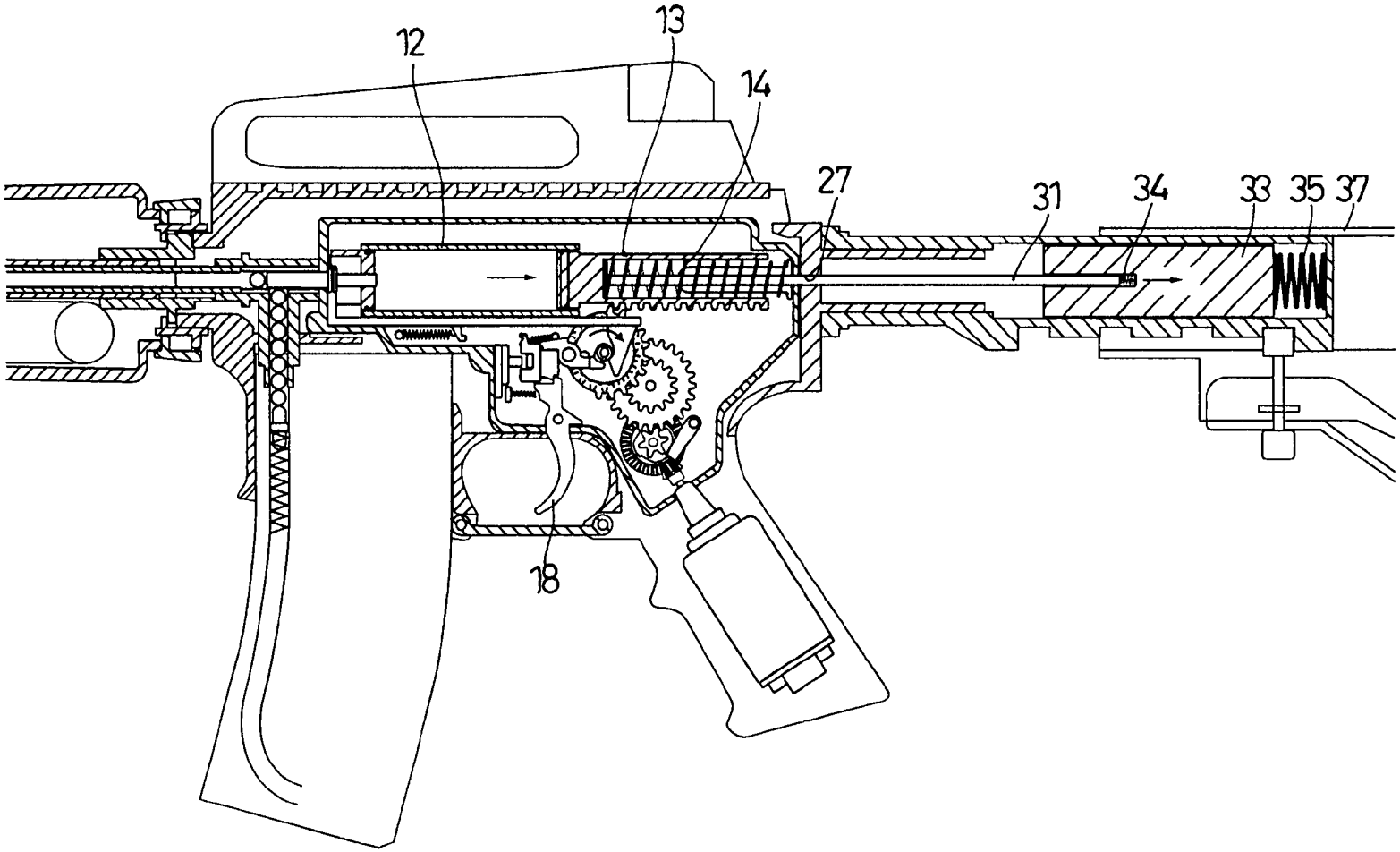
FIG. 3 is a longitudinal sectional view showing that a recoil spring of the device is compressed.
Figure 4:
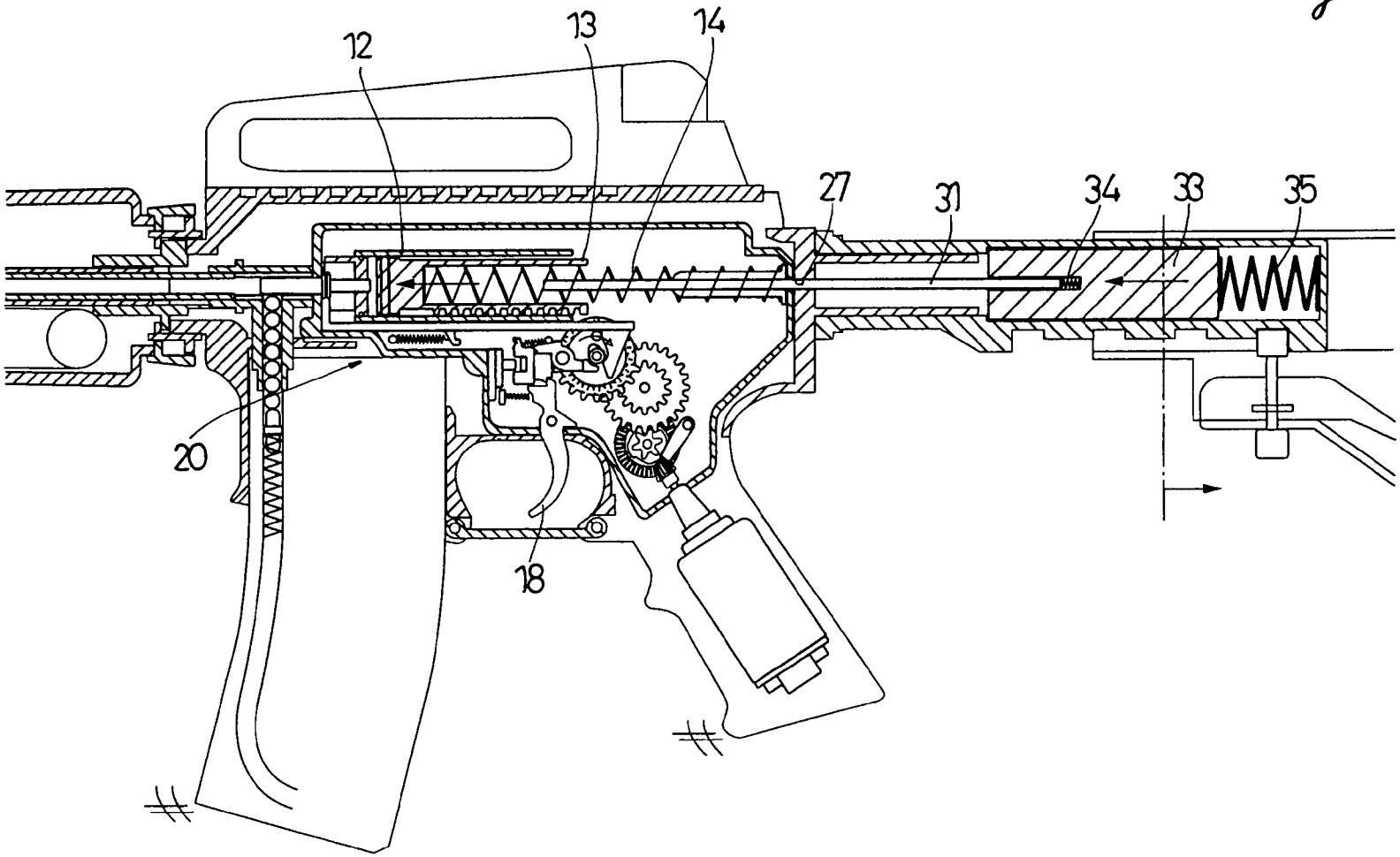
FIG. 4 is a longitudinal sectional view showing that the recoil spring generates a recoil shock.

In the recoil shock device 30 of Example 1 having the above arrangement, at a point of time when the trigger 18 is pulled to rotate the motor 17 to start retreat of the piston 13, the piston retreats without receiving any resistance except for receiving resistance by the piston spring 14. Meanwhile, when the piston 13 abuts against the rod that is the communicating part 31, the communicating part 31 will receive any resistance in its retreating direction (FIG. 2). However, when the communicating part 31 compresses the elastic body 34 at its rear end, and thereafter the communicating part retreats further, compression of a recoil spring 35 is started. At a compression limit of the recoil spring, the load of the weight 33 is transmitted to a main body 37 of the gun (FIG. 3). If the compression limit is exceeded, the recoil spring 35 is switched to extension by its resilient force, and thereby the weight 33 advances. At this time, a shooter feels a reaction against the advancement as a recoil shock (FIG. 4). This recoil shock is intermittently generated while the trigger 18 is pulled.

Figure 5:
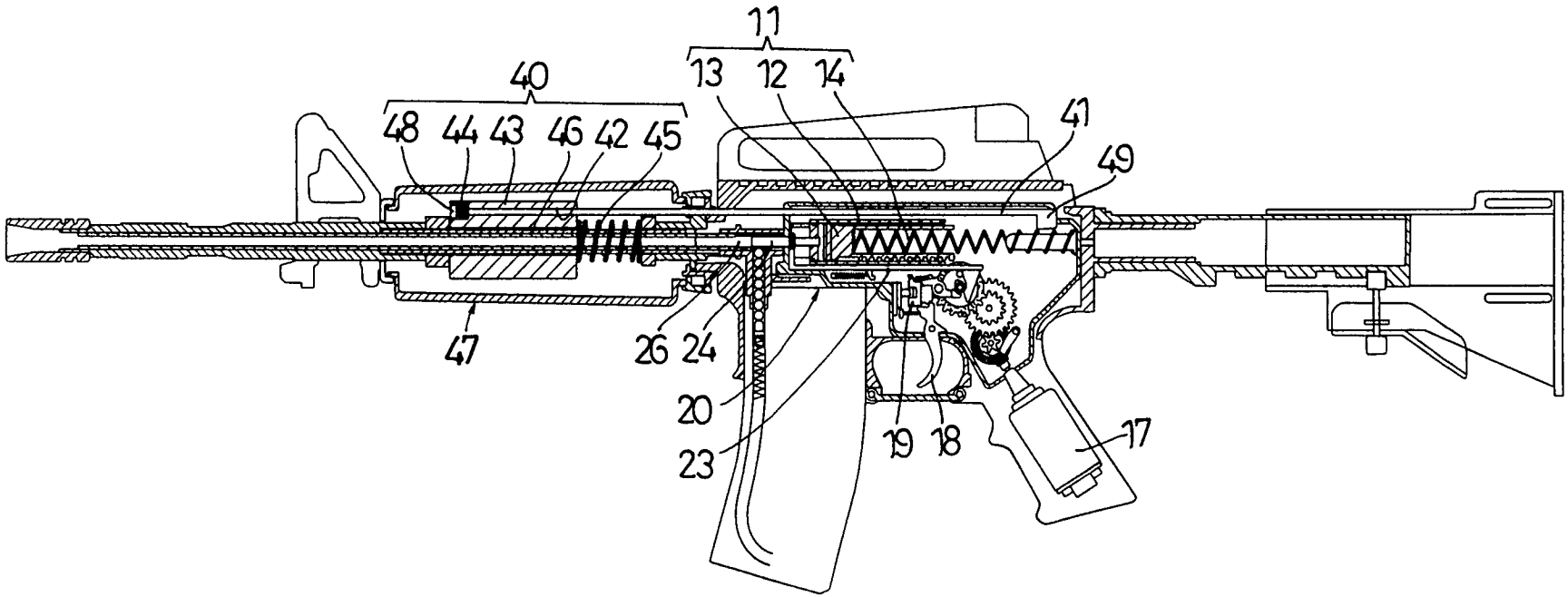
FIG. 5 is a longitudinal sectional view showing Example 2 of the toy gun to which a recoil shock device according to the present invention is applied.
Figure 6:
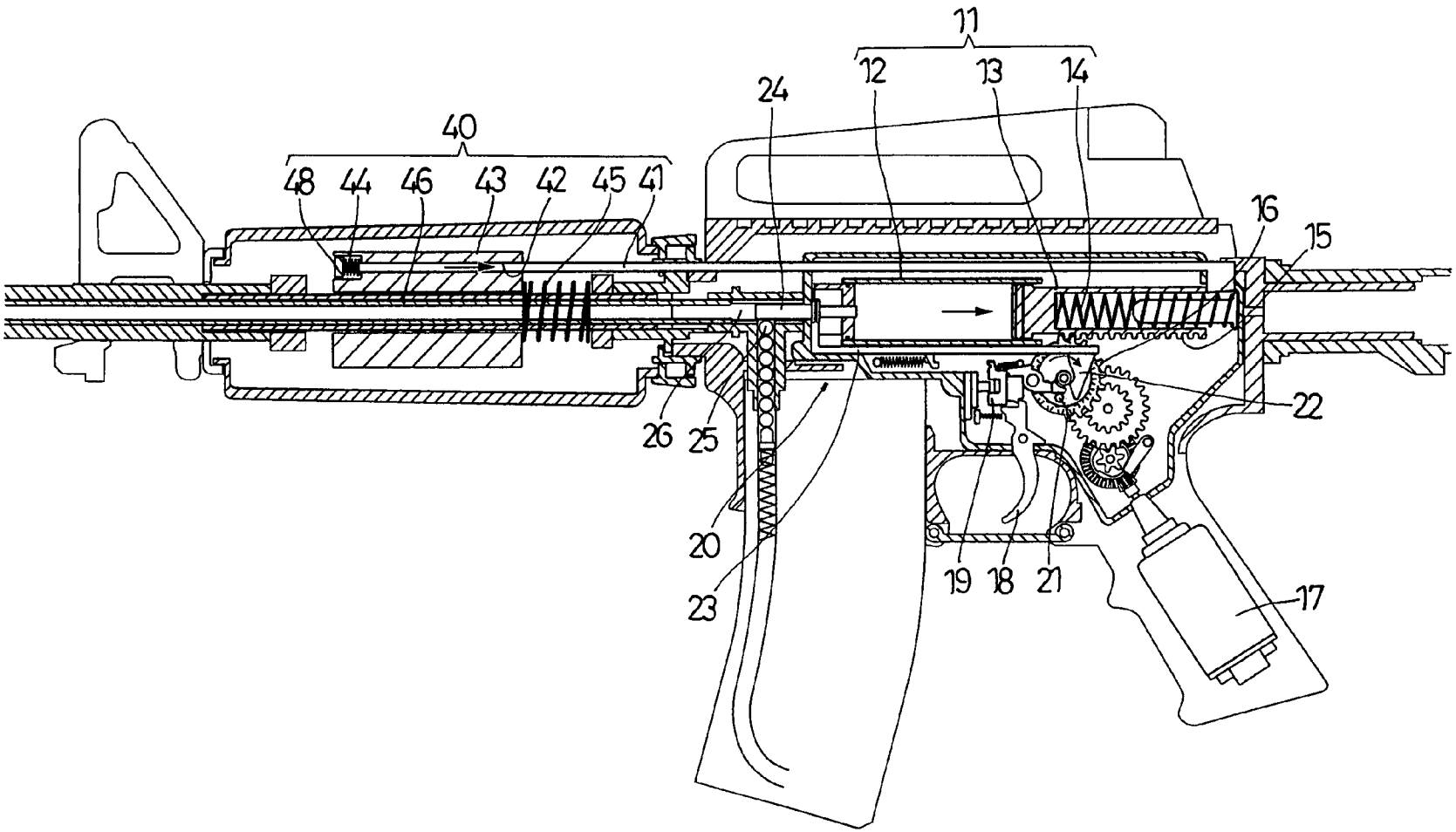
FIG. 6 is a longitudinal sectional view showing that a recoil spring of the device is compressed.

FIGS. 5 and 6 show Example 2 of a device 40 according to the present invention, i.e., an example in which a weight 43 is incorporated in a space 47 provided in front of the engine unit 20. In this Example 2, a communicating part 41 has a one end 49 which is disposed in a position where it is retreated by the piston 13 that is a movable part, and which is formed in the shape of an engageable hook, and has the other end 48 which extends forwardly of the weight 43, and is inserted into a guide hole 42 so as to be connected to a stopper via an elastic body 44. Therefore, a force that accompanies the movement of the piston 13 in its retreating direction pushes the weight 43 rearward from the front to compress a recoil spring 45. The weight 43 of Example 2 is fitted on the outside of a gun barrel 46 and slides thereon, whereas the weight 33 of Example 1 slides within the case 36.

Since the other arrangement of Example 2 is the same as that of Example 1, the operation of the device 40 will be described adopting the reference numerals of Example 1.

When the rear end of the piston 13 is brought into engagement with the one end 49 of the communicating part 41 by retreat of the piston 13 that is a movable part, the weight 43 is moved in its retreating direction to be in a state where it compresses the recoil spring 45 (FIG. 6). Then, after the recoil spring 45 has been compressed, the recoil spring 45 is switched to extension by its resilient force. While this recoil spring 45 is compressed and reaches its full extension, a reaction against the movement of the weight 43 becomes a recoil shock. As a result, a shooter will feel this recoil shock.

Figure 7:
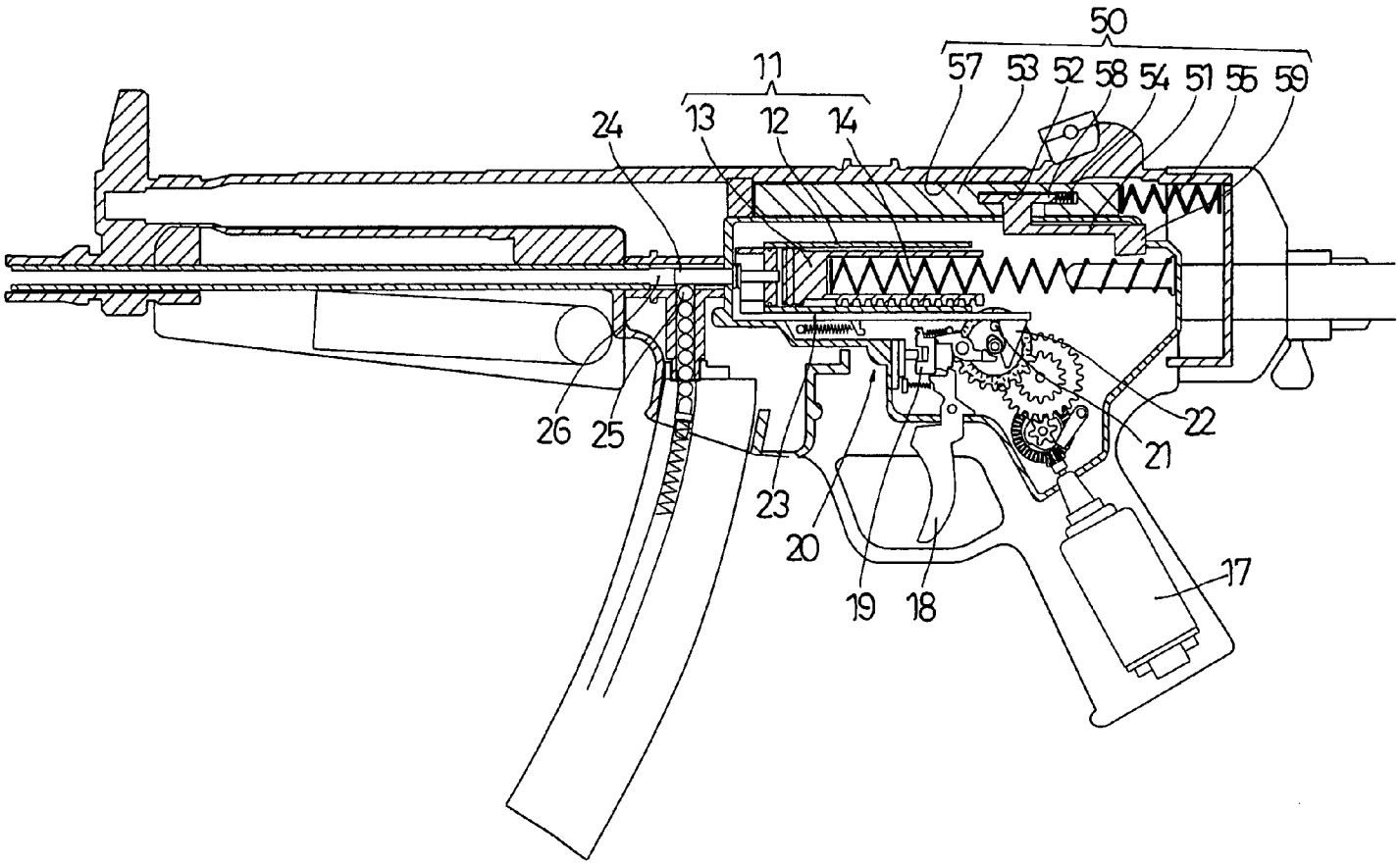
FIG. 7 is a longitudinal sectional view showing Example 3 of the toy gun to which a recoil shock device according to the present invention is applied.
Figure 8:
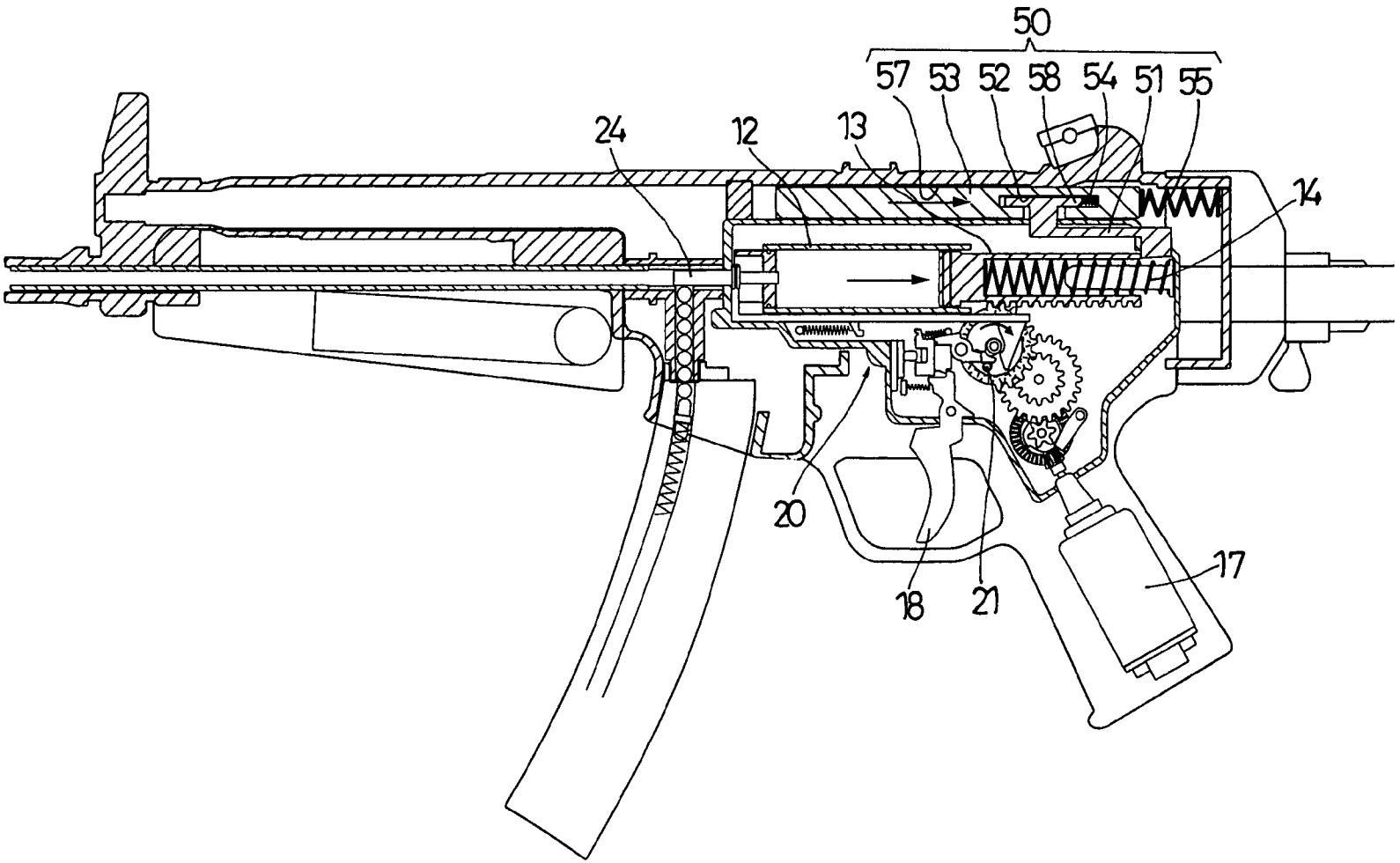
FIG. 8 is a longitudinal sectional view showing that a recoil spring of the device is compressed.

FIGS. 7 and 8 show Example 3 of a device 50 according to the present invention, i.e., an example in which a weight 53 is incorporated in a space 57 provided above the engine unit 20. In Example 3, a communicating part 51 has one end 59 which is disposed in a position where it is retreated by the piston 13 that is a movable part, and which is formed in the shape of an engageable hook, and has the other end 58 which is provided to enter a guide hole 52 for allowing it to move backward and forward inside the weight 53 so that it can move the weight 53 in its retreating direction via an elastic body 54. A force that accompanies the movement of the piston 13 in its retreating direction pushes the weight 53 rearward to compress a recoil spring 55. In the case of Example 3, the weight 53 is provided so as to be capable of sliding backward and forward on constituent wall surfaces of the space 57 between the upper side of the engine unit and the inside of the main body of the gun or within a housing part which is formed in the same shape as the space 57.

In Example 3, when the rear end of the piston 13 is brought into engagement with the one end 59 of the communicating part 51 by retreat of the piston 13 that is a movable part, the weight 53 is moved in its retreating direction to be in a state where it compresses the recoil spring 55. Then, after the recoil spring 55 has exceeded its compression limit, the recoil spring 55 is switched to extension by its resilient force. While this recoil spring 55 reaches its extension from its compression, a reaction against the movement of the weight 53 becomes a recoil shock. As a result, a shooter will feel this recoil shock. The timing of this recoil shock can be adjusted according to the resiliency of the coil spring.

A shock that is caused by driving the weight with a force transmitted from the movable part of the piston/cylinder unit is amplified or cancelled.

The invention claimed is:

1. A recoil shock device in a toy gun, the recoil shock device comprising:

a piston/cylinder unit having a piston spring, a movable part and a fixed part, a communicating part moving in a retreating direction by movement of the movable part, the piston spring being compressed by the movement of the movable part in the retreating direction, a weight, and a recoil spring receiving a force transmitted to the weight via the communicating part by the movement of the movable part in the retreating direction so that the recoil spring is moved into a compressed state, the recoil spring spacing the weight from engagement with a main body of the gun, the weight being movable after the recoil spring and the piston spring are compressed and thereafter during release of the compression of the piston spring, the recoil spring being released and extended by a resilient force of the recoil spring, and a reaction force being transmitted by the weight to the main body of the gun simultaneously with extension of the recoil spring to imitate recoil of the main body of the gun and by the piston spring to create or amplify recoil shock.

2. The recoil shock device in a toy gun according to claim 1, wherein the movable part, the communicating part, and the weight are disposed in this order approximately on a straight line.

3. The recoil shock device in a toy gun according to claim 1, wherein a portion of the communicating part is disposed in a position where the portion of the communicating part is moved by the movable part, and another portion of the communicating part extending parallel to a moving axis of the movable part communicates with the weight.

4. The recoil shock device in a toy gun according to claim 2, wherein an elastic body which is compressed by the retreating direction movement of the communicating part is interposed between the communicating part and the weight or between the piston and the communicating part.

* * * * *